US006991591B1

(12) United States Patent
Tsatsouline

(10) Patent No.: US 6,991,591 B1
(45) Date of Patent: Jan. 31, 2006

(54) HIP FLEXOR INHIBITING ABDOMINAL TRAINING DEVICE

(76) Inventor: Pavel V. Tsatsouline, 17352 W. Sunset Blvd., #703D, Pacific Palisades, CA (US) 90272

( * ) Notice: Subject to any disclaimer, the term of this patent is extended or adjusted under 35 U.S.C. 154(b) by 70 days.

(21) Appl. No.: 10/406,640

(22) Filed: Apr. 2, 2003

Related U.S. Application Data

(60) Provisional application No. 60/369,487, filed on Apr. 3, 2002.

(51) Int. Cl.
*A63B 26/00* (2006.01)

(52) U.S. Cl. ..... 482/140; 482/907; 482/91

(58) Field of Classification Search ..... 482/140, 482/907, 91, 79, 23, 148
See application file for complete search history.

(56) References Cited

U.S. PATENT DOCUMENTS

| | | | | |
|---|---|---|---|---|
| 3,193,288 A | | 7/1965 | Le Vell De Spain et al. | |
| 4,026,548 A | | 5/1977 | Birdwell | |
| 4,073,490 A | | 2/1978 | Feather | |
| 5,122,106 A | * | 6/1992 | Atwood et al. | 482/131 |
| 5,209,482 A | | 5/1993 | Hopfer | |
| 5,779,607 A | * | 7/1998 | Harris | 482/131 |
| 5,921,904 A | * | 7/1999 | Toups | 482/140 |

(Continued)

OTHER PUBLICATIONS

*Ab-Training Controversy Part I*, by Jospeh M. Harrigan, D.C., Sportsmedicine, pp. 166-168, and p. 174, Sep. 1992.
*Ab-Training Controversy Part II*, by Joseph M. Harrigan, D.C., Sportsmedicine, pp. 152-154, Nov. 1992.
*Treatment of Chronic Back Pain*, by V. Janda, Journal of Manual Medicine, vol. 6, No. 5, pp. 166-168, 1992.
*Spinal Stabilization Excerise Program*, by Jerry Hyman and Craig Liebenson, Rehabilitation of the Spine; A Practitioner's Manual, William & Wilkins, Chapter 14, pp. 293-317, 1996.

(Continued)

*Primary Examiner*—Gregory L. Huson
*Assistant Examiner*—L. Amerson
(74) *Attorney, Agent, or Firm*—Patterson, Thuente, Skaar & Christensen, P.A.

(57) ABSTRACT

An abdominal exerciser including a leg rest assembly optionally pivotally connected to a weighted main frame. The leg rest assembly may include a first member and second and third members extending transversely from the first member. One or more pads may be affixed about the first member. The second and third members may terminate in a hinge member such as a female coupler. The main frame may include a plurality of curved members connected at an apex at a first end thereof. Second ends of the members may terminate in a hinge member such as a male coupler. If disconnected, the leg rest assembly and main frame are connected by making the hinge members, e.g., the male and female couplers. A person utilizes the abdominal exerciser by forcing the leg rest assembly downwardly by exerting pressure thereagainst by the person's calves until the person's feet are flat against the floor. The person then exercises by constricting the person's abdominal muscles, while maintaining the person's feet flat against the floor. The weight exerted against the person's calves further enhances the exercise experience. It is emphasized that this abstract is provided to comply with the rules requiring an abstract that will allow a searcher or other reader to quickly ascertain the subject matter of the technical disclosure. Hence, this abstract is submitted with the understanding that it will not be used to interpret or limit the scope or meaning of the claims.

19 Claims, 4 Drawing Sheets

U.S. PATENT DOCUMENTS

| | | | |
|---|---|---|---|
| 6,110,075 | A | 8/2000 | Woodruff |
| 2002/0025895 | A1 * | 2/2002 | Sanchez |
| 2003/0236155 | A1 * | 12/2003 | Yang |

OTHER PUBLICATIONS

*Beyond Crunches: Hard Science, Hard Abs*, by Pavel Tsatsouline, Dragon Door Publications, Inc., pp. Introduction-123, Aug. 1998.

*Classic Crunch V.S. the Ab Pavelizer*, by Pavel Tsatsouline, Beyond Crunches: Hard Science, Hard Abs, John Parrillo's Performance Press, pp. 10-11, Oct. 1999.

*Russian Special Forces Strength Training by Pavel Tsatsouline*, dated Jan. 14, 2002.

* cited by examiner

HIP FLEXOR INHIBITING ABDOMINAL TRAINING DEVICE

CROSS-REFERENCES TO RELATED APPLICATIONS

This application incorporates by reference U.S. patent application Ser. No. 09/439,804, filed 12 Nov. 1999, and claims the benefit of U.S. Provisional Application 60/369,487, filed 3 Apr. 2002 under 35 USC §119(e), also incorporated by reference.

BACKGROUND OF THE INVENTION

1. Field of the Invention

This invention relates to exercise devices and, in particular, this invention relates to devices for exercising a user's abdominal muscles.

2. Background

During muscle training, it is difficult to isolate abdominal muscles from the hip flexors so as to achieve maximal overload and lower back health. A common solution of the prior art is avoiding hip flexion, or sit-ups, by performing only foreword spinal flexion, or by crunches. However, this practice is only marginally effective because eliminating movement in the hip joint does not inhibit the hip flexors. It is well accepted that a muscle contraction in the abdominal muscles will cause a corresponding contraction of adjacent muscles or the hip flexors. (Sherrington's Law of Irradiation) Persons with weak abdominal muscles rely on their hip flexors, even when performing crunches. The stronger hip flexors are recruited first. These hip flexors pull on the lumbar spine causing the back to hyperextend if the trainee's abdominal muscles are not strong enough to counterbalance this pull. Previous attempts to solve the problem of abdominal isolation involved making the crunch stricter. However, none of these approaches has effectively enabled an exercising person to effectively isolate his or her abdominal muscles because they have not addressed the neurological aspect of the problem of abdominal isolation. Moreover, none of these devices has indicated to a person that incorrect technique is being used during an exercise experience.

SUMMARY

This invention substantially meets the aforementioned needs of the industry by providing an exerciser which effectively isolates abdominal muscles during an exercise experience and indicates when the exercise is being improperly performed.

The invention is directed to equipment for strengthening and toning abdominal muscles. The present invention overrides undesirable contraction of corresponding muscle groups and inhibits the hip flexors during abdominal contraction with another physiological phenomenon, Reciprocal Inhibition (also one of Sherrington's Laws). When a muscle contracts, its antagonist relaxes. In the context of the present exerciser, contraction of the hip extensors inhibits the hip flexors, thereby effectively isolating the abdominals and relieving lower back stress.

And exerciser of the present invention is provided. The exerciser may include a leg rest and a main frame assembly. The leg rest may have a first frame portion separated at substantially orthogonal bends from a second frame portion and a third frame portion. A first hinge member may be present at ends of the second and third frame portions. The main frame assembly may be in mechanical communication with the leg rest assembly and may have first and second tubing portions, each of the first and second tubing portions with first and second ends. The first end of the first and second tubing portions may terminate in a second hinge member. A second ends of the first and second tubing portions may be joined at an apex. Each of the second and members are matable with one of the first and members of the second and third frame portions via hinge members. A weight may be mounted to the exerciser proximate the apex formed by joined first and second tubing portions.

A method of exercising a person's abdominal muscles is provided. In the provided method an exerciser is supinely disposed on a substantially flat surface. The exerciser may include a leg rest assembly in rigid mechanical communication with a weighted main frame. The method may include exerting a downward force on the leg rest assembly and contracting the person's abdominal muscles. The downward force on the leg rest assembly is exerted until the heels and balls of the person's feet contact the flat surface, thereby displacing the main frame from resting on the flat surface. When the person contracts the person's abdominal muscles, the heel and ball of the person's feet are maintained in contact with the flat surface.

There is also provided a method of making an exerciser. The method may include: forming a first end and a second end in a tubing piece, thereby defining a leg rest assembly with a first member, a second member, and a third member. The second and third members may generally transversely extend from the first member; obtusely bending a third and a fourth tubing piece; joining a first end of each of the third and fourth tubing pieces at an apex; installing a first hinge member at an end of each of the second member and the third members; and installing a second hinge member at a second end of the third and fourth tubing pieces.

These and other objects, features, and advantages of this invention will become apparent from the description which follows, when considered in view of the accompanying drawings.

A detailed description of the present invention is depicted in the accompanying figures, which are intended to be only illustrative of the present invention and are not contemplated to limit the scope thereof.

Figure 1:
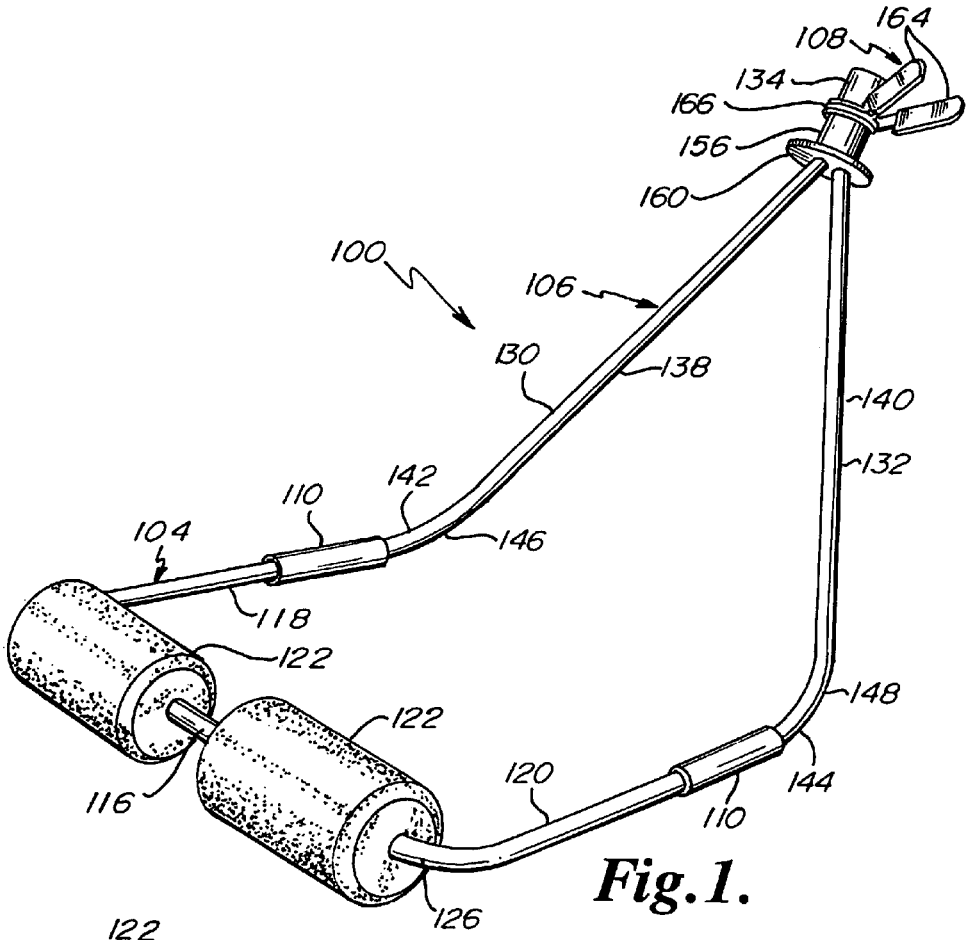
FIG. 1 is a perspective view of the present exerciser.

It is understood that the above-described figures are only illustrative of the present invention and are not contemplated to limit the scope thereof.

DETAILED DESCRIPTION

Any references to such relative terms as proximal and distal, top and bottom, inboard and outboard, or the like are intended for convenience of description and are not intended to limit the present invention or its components to any one positional or spatial orientation. All dimensions of the components in the attached figures may vary with the potential design and the intended use of an embodiment of the invention without departing from the spirit and scope thereof.

Each of the additional features and methods disclosed herein may be used separately or in conjunction with other features and methods to provide improved exercisers and methods for using and making the same. Representative examples of the teachings of the present invention, which examples utilize many of these additional features and methods, will now be described in detail with reference to the drawings. This detailed description is intended merely to teach a person of ordinary skill in the art further details for practicing aspects of the present teachings and is not intended to limit the scope of the invention. Therefore, specific combinations of features and methods disclosed in the following detailed description may not be necessary to practice the invention in its broadest sense and are instead taught merely to particularly describe representative embodiments of the invention.

The present exercise device effectively isolates a person's abdominal muscles during an exercise experience. One consideration heretofore unrecognized when seeking to isolate a person's abdominal muscles is the role performed by the person's hamstring and related muscles. Hamstrings have two functions: hip extension and knee flexion. When the hamstrings are used as hip extensors, the hamstrings contract synergistically with the gluteals. In the context of the Janda sit-up, this phenomenon means that the trainee's heels will be pressing against the floor. When the hamstrings act as knee flexors, the hip flexors also tend to become activated. In the context of the Janda sit-up, this phenomenon dictates that the trainee's heels will be dragging towards the trainee's hips, or vice versa, especially when the trainee is struggling to complete the exercise movement. When the hip flexors are activated, the purpose of the exercise is defeated. Hence, it is imperative to enforce the hip extension functions of the hamstrings. With the present non-anchored active resistance, the trainee has a flexor inhibiting abdominal training device, which accomplishes hip extension of the hamstrings by providing the trainee with immediate feedback when the trainee performs a knee flexion/hip flexion-rather than a hip extension. If the exercise is performed incorrectly, the present device will be dragged toward the trainee's hips or the trainee will be dragged toward the device even though rubber or other friction-increasing material is applied to the pivot points.

The present device also provides another type of feedback to disencourage hip flexor contraction. The foam rollers of the present device press up against the trainee's calves, thereby tending to force the trainee's feet off the floor. When the trainee attempts to keep the trainee's feet flat on the floor, the trainee must accomplish this by activating the trainee's hip extensors. The trainee's feet coming off the floor, especially near the top of the movement, provides feedback that the trainee's hip extensors are not sufficiently activated, thus enforcing the proper form in another fashion.

Figure 2:
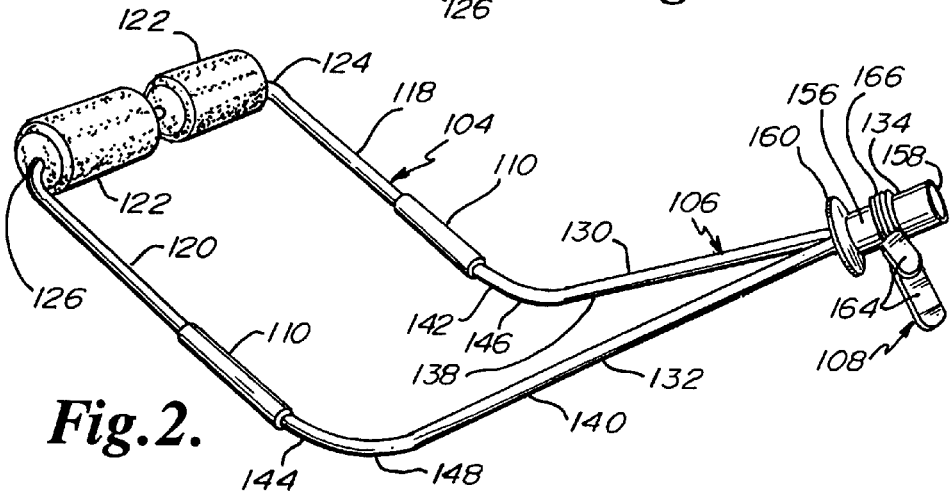
FIG. 2 is another perspective view of the present exerciser.
Figure 3:
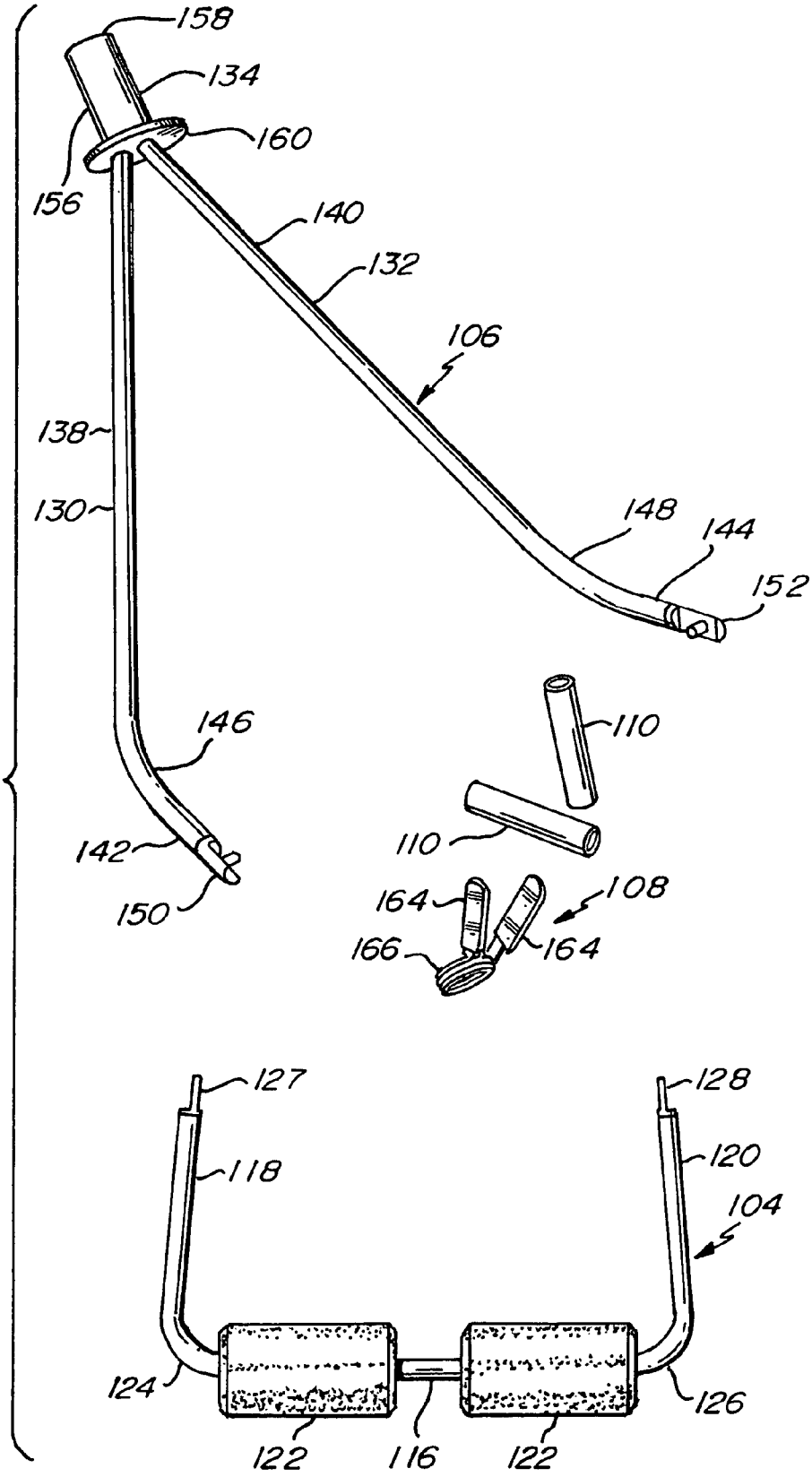
FIG. 3 is an exploded view of the exerciser of FIG. 1.
Figure 5A:
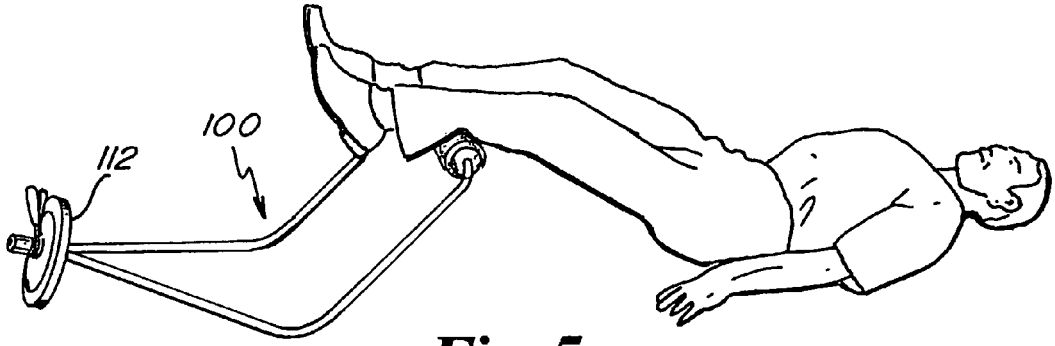
FIGS. 5*a*–5*d* depict a person exercising with the exerciser of FIG. 1.
Figure 5B:
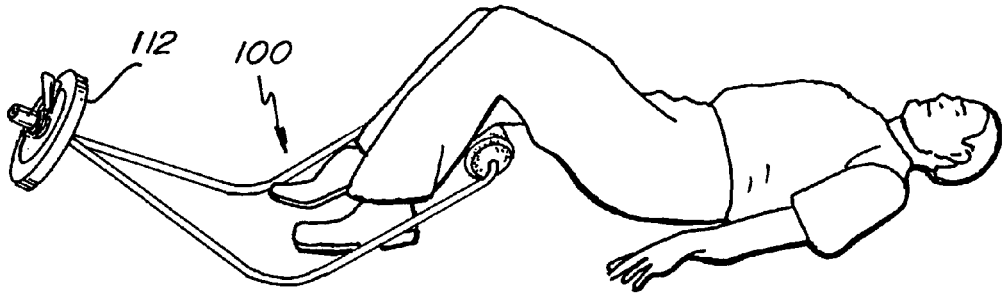
Figure 5C:
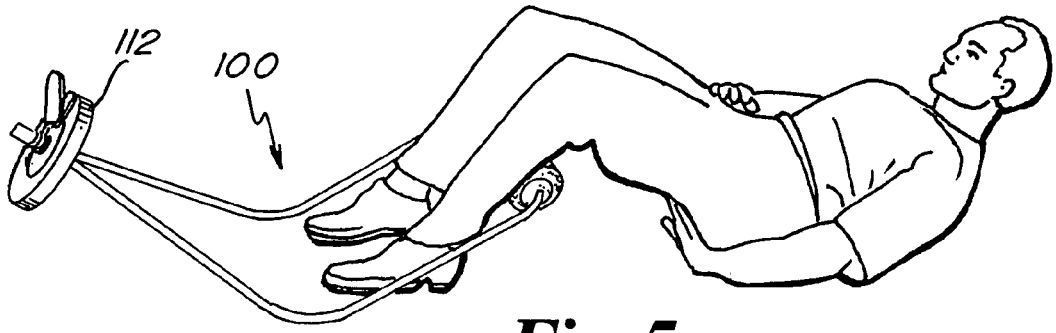

One embodiment of the present exerciser is depicted in the figures generally at 100 and, referring to FIGS. 1–3, includes a leg rest assembly 104, a main frame assembly 106, a retainer such as a spring collar 108, a locking device such as locking tubes 110 (in combination with hinge members such as male and female couplers disposed on the leg rest assembly 104 and the main frame 106, infra), and a weight (FIGS. 5*a*–5*c*). The leg rest assembly 104 of this embodiment includes respective first, second, and third members 116, 118, and 120 and optionally at least one padding device such as a pair of foam pads 122. The foam pads may be attached to the pipes or may rotate freely. Freely rotating pads may enforce stricter exercise performance, as they demand that the trainee pushes against them at a very precise angle; failure to do so will make the trainee's calves slip. A stricter exercise performance is understood to mean that the trainee's target muscle groups, e.g., abdominals, experience more adaptive overload. The second and third members 118 and 120 are unitarily (or otherwise integrally) joined to the first member 116 by bends 124 and 126, respectively. Female couplers 127 and 128 are inserted and held, e.g., by friction at the ends of respective second and third members 118 and 120. In the embodiment shown, the bends 124 and 126 are oriented transversely, e.g., at right angles (+/−5, 10) degrees, with respect to the first member 116 and may be characterized by radiuses of about 2.75 (+/−0.5, 1.0) inches. Also in the embodiment depicted, the first member 116 is about 15.5 (+/−1.0) inches and the second and third members 118 and 120 are about to 9.5 (+/−0.5, 1) inches, excluding portions of the bends 124 and 126. If present, the foam pads 122 are made from a foamed synthetic resin, e.g., foam rubber. Other suitable resins may be identified by a person of ordinary skill in the art with out undue experimentation from the Handbook of Plastics, Elastomers, and Composites, Third Edition, herein incorporated by reference.

The main frame assembly 106 has a pair of main frame members 130 and 132 and a cap 134. The respective main frame members 130 and 132 unitarily (or otherwise integrally) include first portions 138 and 140 and second portions 142 and 144 joined at obtuse bends 146 and 148, respectively. The second portions 142 and 144 terminate in male couplers 150 and 152. In the embodiment shown, the bends 146 and 148 are about 110 (+/−5) degrees and are described by radiuses of about 6 (+/−0.5) inches. Also in the embodiment depicted, the first and second portions 138 and 140 are about 20 (+/−0.5, 1) inches in length. The main frame members 130 and 132 are fixed together at an apex, e.g., by welding connectors (e.g., rivets, bolts/nuts), or the like. Alternatively the main frame members 130 and 132 may be fixed together by the cap 134. The cap 134, in turn, includes a cylindrical portion 156, an optional top cover 156, and a lower flange 160. The cylindrical portion 156 may be about 4 (+/−0.5, 1) inches in length and have a radius of about 1 (+/−0.5) inch. The cap 134 and flange 116 may have dimensions substantially similar to those of a similar device for mounting Olympic-size barbells.

The locking tubes 110 may be about 6 (+/−0.5, 1.0) inches long and have a radius of about 0.5 (+/−0.25) inch. The spring collar 108 includes a pair of handles 164 extending from a generally circular spring member 166. Forcing the handles 164 toward each other biases the spring element 166, thereby increasing the diameter of the spring element 166. The spring element 166 is dimensioned to fit snugly about the circumference of the cylindrical element 156, especially when in an unbiased position.

Figure 4:
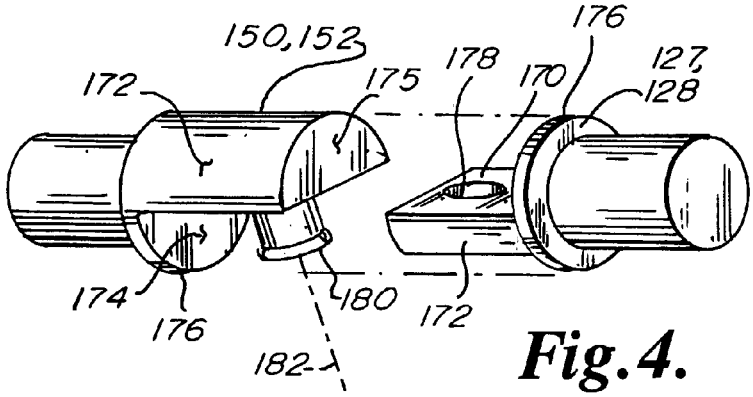
FIG. 4 is a perspective view of a female coupler and a male coupler operably present in the exerciser of FIG. 1.

The present male and female couplers are present at the ends of the leg rest assembly first and second members 118 and 120 and at the ends of the main frame second portions 142 and 144, e.g., by being forced inside the tubings from which these structures are constructed and frictionally held therein. While the present female couplers are shown as being present in the leg rest assembly and the present male couplers as being present in the main frame, it should be appreciated that male couplers could be used with the present leg rest assembly and that female couplers would be used with the present main frame. It should also be recognized that a person of ordinary skill in the art would readily identify several equivalent structures to the present male and female couplers without undue experimentation. Referring to FIG. 4, the female couplers 127 and 128 and the male couplers 150 and 152 each display a first surface, such as a lateral surface 170, intersecting a generally arcuate surface 172 and further intersecting a second surface, such as a vertical surface 174. Each coupler may also terminate in a distal surface 175. The vertical surface 174 is a distal surface to a flange element 176. Each female coupler 127 and 128 defines a bore 178 extending between the lateral surface 170 and the arcuate surface 172. Each male coupler 150 and 152 includes a male extension 180 extending from the lateral surface 170. The male extension 180 is dimensioned to fit snugly within the bore 178. In some embodiments, a fastener, such as a cotter pin (not shown), is extended through a bore (not shown) in the male extension 180 to retain the male extension 180 within the bore 178. The lateral surface 170 may be dimensioned, and the male extension 180 disposed, such that joined female couplers 127 and 128 and male couplers 150 and 152 pivot about a longitudinal axis 182 of the male extension 180. In other embodiments, the lateral surface 170 is dimensioned and the male extension 180 is disposed such that the joined female couplers 127 and 128 and male couplers 150 and 152 are substantially rigid because the distal surfaces 175 of the present male couplers abut the vertical surfaces 174 when the present couplers are joined.

A suitable embodiment of the present leg rest assembly and main frame has been made from Schedule 40½ inch pipe. The main frame cap cylindrical portion 156 may be constructed from 2 inch diameter, 14 gauge tubing and the locking tubes 110 may be made from 1 in. diameter, 14 gauge tubing. Various steel alloys have been used for the tubing in the foregoing elements. However, a person of ordinary skill in the art will recognize that several other materials may be suitable for other embodiments. Suitable synthetic resins may be identified by persons of ordinary skill in the art without undue experimentation from "Handbook of Plastics, Elastomers, and Composites, Third Addition," Charles A. Harper Editor in Chief, McGraw-Hill, New York (1996), hereby incorporated by reference.

The present exerciser may be assembled by sliding the foam pads 122 past the second or third member 118 or 120 and spacing the foam pads 122 generally equidistantly on the first member 116. Each of the second and third members 118 and 120 may then be extended through one of the locking tubes 110 so as to expose the female couplers 127 and 128. The female couplers 127 and 128 are then joined to the male couplers 150 and 152 by disposing the male extensions 180 of one of the male couplers 150 and 152 through the bores 178 of the female couplers 127 and 128. In one embodiment, the leg rest assembly 104 and the main frame 106 may then be pivoted when the present male and female couplers are joined as described supra. When in the folded position, the present exerciser 100 may be unfolded and secured in an unfolded, locked position by sliding the locking tubes 110 over the joints formed by joined female and male couplers 127–128 and 150–152. When the locking tubes 110 are in position, the weight 112 is mounted on the cap 134 and secured in place by the spring collar 110 (FIGS. 5*a*–5*c*). The weight 112 may be a plate weight commonly available for barbells or the like. The foregoing embodiment may be folded by removing the weight 112 from the cap 134, sliding the locking tubes 110 toward the pads 122 thereby exposing the joints formed by joining the present female and male couplers, and pivoting the leg rest assembly 104 toward the main frame 106.

In use and referring to FIGS. 5*a*–5*d*, a person advantageously utilizes the present exerciser to strengthen the person's abdominal muscles. The present exerciser is assembled or unfolded and secured as described supra. The weight 112 may weigh from 10 to 25 pounds. The amount of weight, however, is determined by the desire and level of conditioning of the person. The present exerciser is then placed ideally on a non-slippery surface, such as a carpet or mat.

Figure 5D:
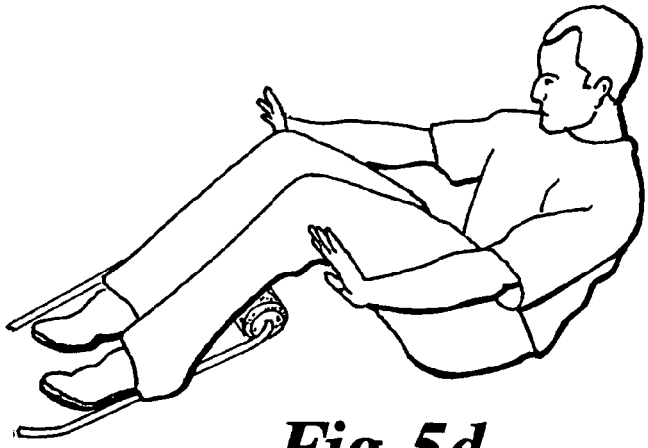

The person then lies in a supine position with the person's back on the floor and the person's calves atop the pads 122 (FIG. 5*a*). The person then forces their calves against the pads until their feet contact the floor, thereby raising the weight from a contacting position with the floor, e.g., the heels and balls of the person's feet are pressed against, or contacting, the floor (FIG. 5*b*). At this point, the person's knees may be bent at a 90 degree angle (the person's calves are generally orthogonal to the person's thighs) and the pads 122 are contacting, or pressing against, the person's calves, e.g., about halfway between the person's feet and knees. At this point the person is in a proper position to begin exercising. The person then begins to tighten the muscles in the person's buttocks (gluteals), ideally slowly and without jerking movements. Simultaneously with tightening the buttock muscles, the person constricts the person's abdominal muscles, thereby performing a partial sit-up (or crunch) (FIGS. 5*c* and 5*d*). Ideally, the person should require at least two seconds to perform this exercise. The exercise is properly performed keeping the person's feet flat on the floor and without dragging the present exerciser or the person's body across the floor. After the partial sit-up or crunch has been performed, the person slowly relaxes until the person's head is resting on the floor (FIG. 5*a*) to complete an exercise replication. It may be desirable for the person to rest a brief time before performing another replication.

The present exerciser is advantageously effective in exercising a person's abdominal muscles because the present exerciser prevents the person's hip flexors from aiding in the sit-up protocol. To this end, the present exerciser applies an upward force to the person's calves and, thereby, eliminates the anchor point necessary for hip flexors to function. Stated otherwise, exerting an upward force on the person's calves during this exercise totally eliminates any possible anchor point for the person's hip flexors. Totally eliminating any possible anchor point for the person's hip flexors prevents the hip flexors from aiding the person's abdominal muscles during exercise and forces the person's abdominal muscles to perform the exercise in isolation. Moreover, if the person attempts to use the person's hip flexors by pulling the person's knees toward the person's chest, the present device is pulled toward the exerciser, thereby indicating that the person is exercising improperly. The present exerciser further enhances the exercise experience by forcing the person's gluteal muscles to contract when maintaining the present exerciser in the preferred position. Thus, another indication that the person is performing the exercise improperly is in response to the person relaxing the person's gluteal muscles, wherein the weight lifts the person's feet from the floor.

Because numerous modifications of this invention may be made without departing from the spirit thereof, the scope of the invention is not to be limited to the embodiments illustrated and described. Rather the scope of the invention is to be determined by the appended claims and their equivalents.

What is claimed is:

1. An exerciser, comprising:

a leg rest assembly comprising a first frame portion and a second and third fame portion, the second and third frame portions transversely extending from the first frame portion and terminating in a first hinge member;

a main frame assembly in rigid mechanical communication with the leg rest assembly and including first and second tubing portions, each of said first and second tubing portions including a first end and a second end, the first end of each said first and second tubing portions terminating in a second hinge member, the second end of each said first and second tubing portions joined at an apex, each said second hinge member mating with one of said first hinge members of said second and third frame portions of said leg rest assembly, the first hinge member comprising one of a female coupler and a male coupler and the second hinge member comprising the other of the female coupler and the male coupler.

2. The exerciser of claim 1, in which the second and third frame portions extend generally orthogonally from the first frame portion.

3. The exerciser of claim 1, the leg rest frame further comprising a plurality of pads disposed about the first frame portion.

4. The exerciser of claim 1, the first hinge member comprising the female coupler and the second hinge member comprising the male coupler.

5. The exerciser of claim 1, the main frame assembly further comprising a retaining cap operably disposed about said second ends of said main frame assembly first and second tubing portions.

6. The exerciser of claim 5, further comprising a weight-retaining device attachable to the retaining cap and comprising a first end and a second end and a plurality of handles, one of said plurality of handles affixed to each of said first and second ends.

7. The exerciser of claim 5, the retaining cap comprising a generally cylindrical portion and a flange extending from the cylindrical portion.

8. The exerciser of claim 1, further comprising a removable weight attachable to the main frame.

9. A method of exercising a person's abdominal muscles by utilizing an exerciser disposed on a substantially flat surface, the exerciser comprising a leg rest assembly and a weighted main frame, the leg rest assembly and main frame held in rigid mechanical communication by a female coupler joined to a male coupler, the leg rest assembly comprising one of the female coupler and the male coupler, the leg rest assembly comprising the other of the female coupler and the male coupler, the method comprising:

exerting a downward force on the leg rest assembly until the heel and ball of the person's feet contact the flat surface, thereby displacing the main frame from resting on the flat surface; and contracting the person's abdominal muscles, while maintaining the heel and ball of the person's feet in contact with the flat surface.

10. The method of claim 9, in which the exerciser raises the person's feet from the flat surface when the person's abdominal muscles are contracted while not maintaining the heel and ball of the person's feet in contact with the flat surface, thereby indicating an improperly performed exercise protocol.

11. The method of claim 9, further comprising relaxing the person's abdominal muscles while maintaining the heel and ball of the person's feet in contact with the flat surface.

12. A method of making an exerciser, comprising:

forming a first bend and a second bend in a first tubing piece, thereby defining a leg rest assembly with a first member, a second member, and a third member, the second and third members generally transversely extending from the first member; and obtusely bending a third and a fourth tubing piece;

a first end of each of the third and fourth tubing pieces being joinable at an apex;

a first hinge member being installable at an end of each of the second member and the third member; and a second hinge member being installable at a second end of the third and fourth tubing pieces.

13. The method of claim 12, in which said third and said fourth tubing pieces are bent at an angle between about 100 and 120 degrees.

14. The method of claim 12, in which the second and third members extend generally orthogonally from the first member.

15. The method of claim 12, in which the first hinge member comprises a female coupler, the female coupler defining a bore.

16. The method of claim 12, in which the second hinge member comprises a male coupler, the male coupler comprising a male extension.

17. The method of claim 12, further comprising disposing a cap about said apex formed by joining each of said third and fourth tubing pieces.

18. The method of claim 17, further comprising providing a spring collar disposable about the cap.

19. The method of claim 12, further comprising disposing at least one cushion about said first member.

* * * * *